US008166599B2

(12) United States Patent
Tomm

(10) Patent No.: US 8,166,599 B2
(45) Date of Patent: May 1, 2012

(54) ARTICULATED LINK DUSTER AND DUSTER SUPPORT FRAME

(76) Inventor: Erwin Tomm, Cleveland, OH (US)

( * ) Notice: Subject to any disclaimer, the term of this patent is extended or adjusted under 35 U.S.C. 154(b) by 512 days.

(21) Appl. No.: 12/121,973

(22) Filed: May 16, 2008

(65) Prior Publication Data

US 2008/0282492 A1 Nov. 20, 2008

Related U.S. Application Data

(60) Provisional application No. 60/930,768, filed on May 18, 2007.

(51) Int. Cl.
*A47L 13/24* (2006.01)
*A47L 13/38* (2006.01)

(52) U.S. Cl. ..... 15/147.2; 15/144.1; 15/209.1; 15/210.1; 15/228

(58) Field of Classification Search ..... 15/144.1, 15/144.2, 147.1, 147.2, 104.16, 104.165, 15/209.1, 210.1, 211, 228, 229.1–229.4, 15/229.6–229.8
See application file for complete search history.

(56) References Cited

U.S. PATENT DOCUMENTS

| | | | | |
|---|---|---|---|---|
| 270,979 | A * | 1/1883 | Pike | 15/104.16 |
| 1,388,560 | A * | 8/1921 | De Graff | 15/104.068 |
| 1,544,635 | A * | 7/1925 | De Graff | 15/104.068 |
| 2,395,245 | A * | 2/1946 | Booharin | 15/144.2 |
| 3,066,344 | A | 12/1962 | Garcia Borrás et al. | |
| 4,731,896 | A * | 3/1988 | de La Tour | 15/106 |
| 4,765,014 | A | 8/1988 | Moss et al. | |
| 5,255,994 | A * | 10/1993 | Stein | 403/95 |
| 5,471,698 | A * | 12/1995 | Francis et al. | 15/144.1 |
| D371,655 | S | 7/1996 | Weston | |
| 6,032,321 | A * | 3/2000 | Shirey et al. | 15/244.2 |
| 6,047,435 | A * | 4/2000 | Suzuki et al. | 15/229.8 |
| D435,948 | S | 1/2001 | Long | |
| D500,183 | S | 12/2004 | Bensussan et al. | |
| D504,199 | S | 4/2005 | Bensussan et al. | |
| 7,356,869 | B2 | 4/2008 | Knopow et al. | |
| 2002/0078519 | A1 * | 6/2002 | Boothby | 15/121 |

* cited by examiner

*Primary Examiner* — Mark Spisich
(74) *Attorney, Agent, or Firm* — Fay Sharpe LLP

(57) ABSTRACT

In accordance with another aspect of the present development, an articulated link duster support frame includes a base and a working region connected to the base. The working region includes a plurality of links pivotally connected in series such that each link is pivotally connected to at least one adjacent link, with an inner one of said links pivotally connected to the base. Respective articulated joints pivotally connect the inner link to the base and pivotally connect each link to at least one adjacent link. Each joint includes a first side comprising at least two ears and a second side comprising at least one tab located between and slidably abutted with the at least two ears of said first side. Each joint further includes a fastener pivotally connecting the first and second joint sides. A fabric, feather, or other dusting member is connected to the working region.

13 Claims, 3 Drawing Sheets

ARTICULATED LINK DUSTER AND DUSTER SUPPORT FRAME

CROSS-REFERENCE TO RELATED APPLICATION

This application claims priority from and benefit of the filing date of U.S. provisional application Ser. No. 60/930,768 filed May 18, 2007, and said prior provisional application Ser. No. 60/930,768 is hereby expressly incorporated by reference into this specification.

BACKGROUND

Prior duster devices are known but have been deemed deficient for a variety of reasons. Prior rigid support frame dusters are not able to be adjusted in shape to facilitate dusting elevated, distant, and/or angled surfaces. Prior adjustable support frame dusters use a bendable metal strip as a support frame for holding the dusting cloth or other dusting member, but the metal strip is difficult to straighten or flatten after bending, which leads to difficulty dusting flat surfaces, and the metal strip weakens and/or breaks after repeated reshaping. As such, a need has been identified for a duster with a support frame that is adjustable but that also holds its shape and resists weakening or breaking over time.

SUMMARY

In accordance with one aspect of the present development, an articulated link duster support frame includes a base and a working region connected to the base and adapted to support a dusting member. The working region includes at least one link pivotally secured to the base by a joint. The joint includes at least two ears and at least one tab located between and slidably abutted with the ears. The joint further includes a fastener installed in respective aligned apertures of the at least two projecting ears and the at least one tab. The at least two ears project outwardly from one of the base or the at least one link, and the at least one tab projects outwardly from the other of the base and the at least one link.

In accordance with another aspect of the present development, an articulated link duster includes a base and a working region connected to the base. The working region includes a plurality of links pivotally connected in series such that each link is pivotally connected to at least one adjacent link, with an inner one of said links pivotally connected to the base. A dusting member is installed on the working region. Respective articulated joints pivotally connect the inner link to the base and pivotally connect each link to at least one adjacent link. Each joint includes a first side including at least two ears and a second side including at least one tab located between and slidably abutted with the at least two ears. Each joint further includes a fastener that pivotally connects the first and second sides.

In accordance with another aspect of the present development, an articulated link duster support frame includes a base and a working region connected to the base. The working region includes a plurality of links pivotally connected in series such that each link is pivotally connected to at least one adjacent link, with an inner one of said links pivotally connected to the base. Respective articulated joints pivotally connect the inner link to the base and pivotally connect each link to at least one adjacent link. Each joint includes a first side comprising at least two ears and a second side comprising at least one tab located between and slidably abutted with the at least two ears of said first side. Each joint further includes a fastener pivotally connecting the first and second joint sides.

DETAILED DESCRIPTION

Figure 1:
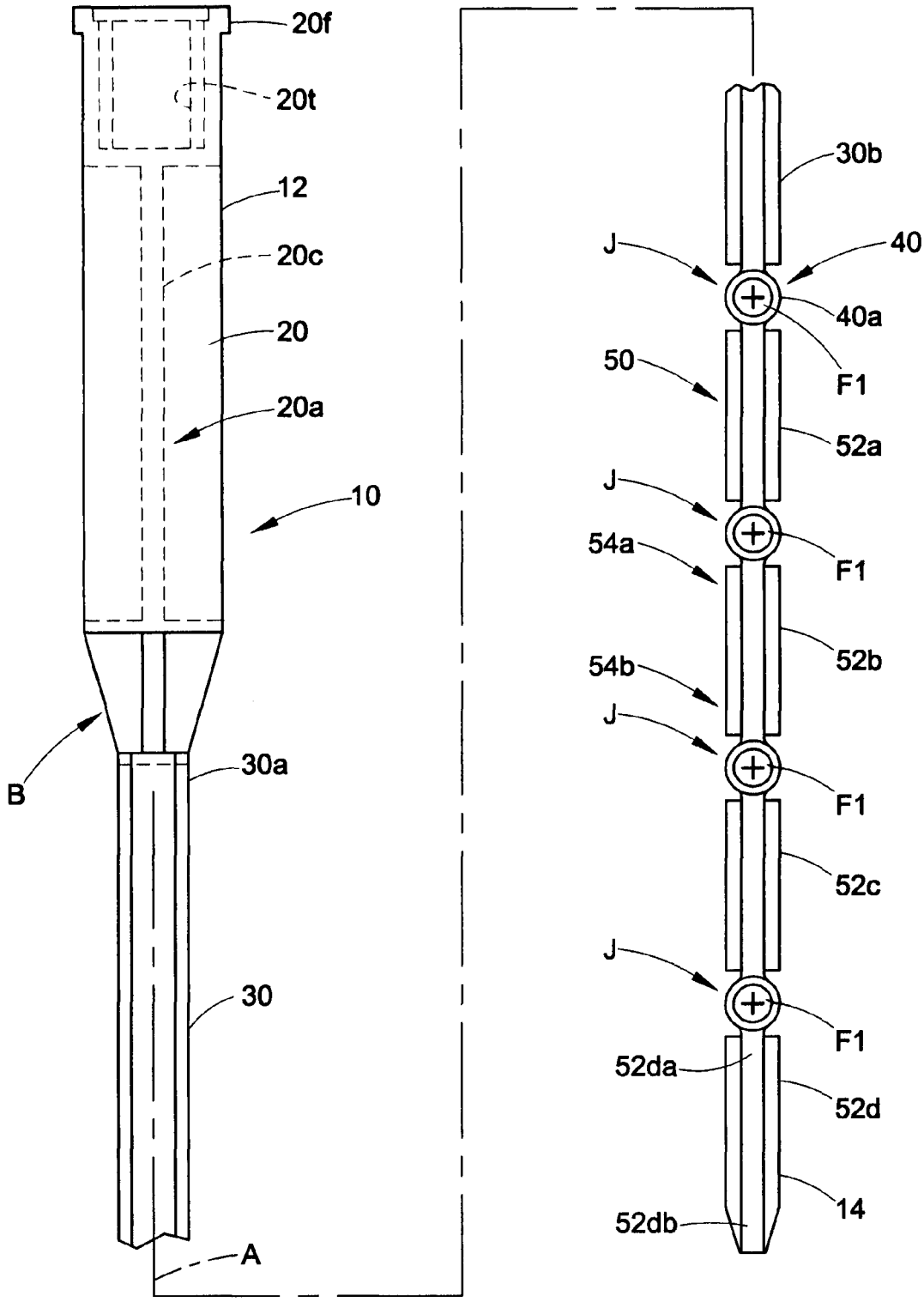
FIG. 1 is a side view of an articulated link duster support frame formed in accordance with the present invention.
Figure 2:
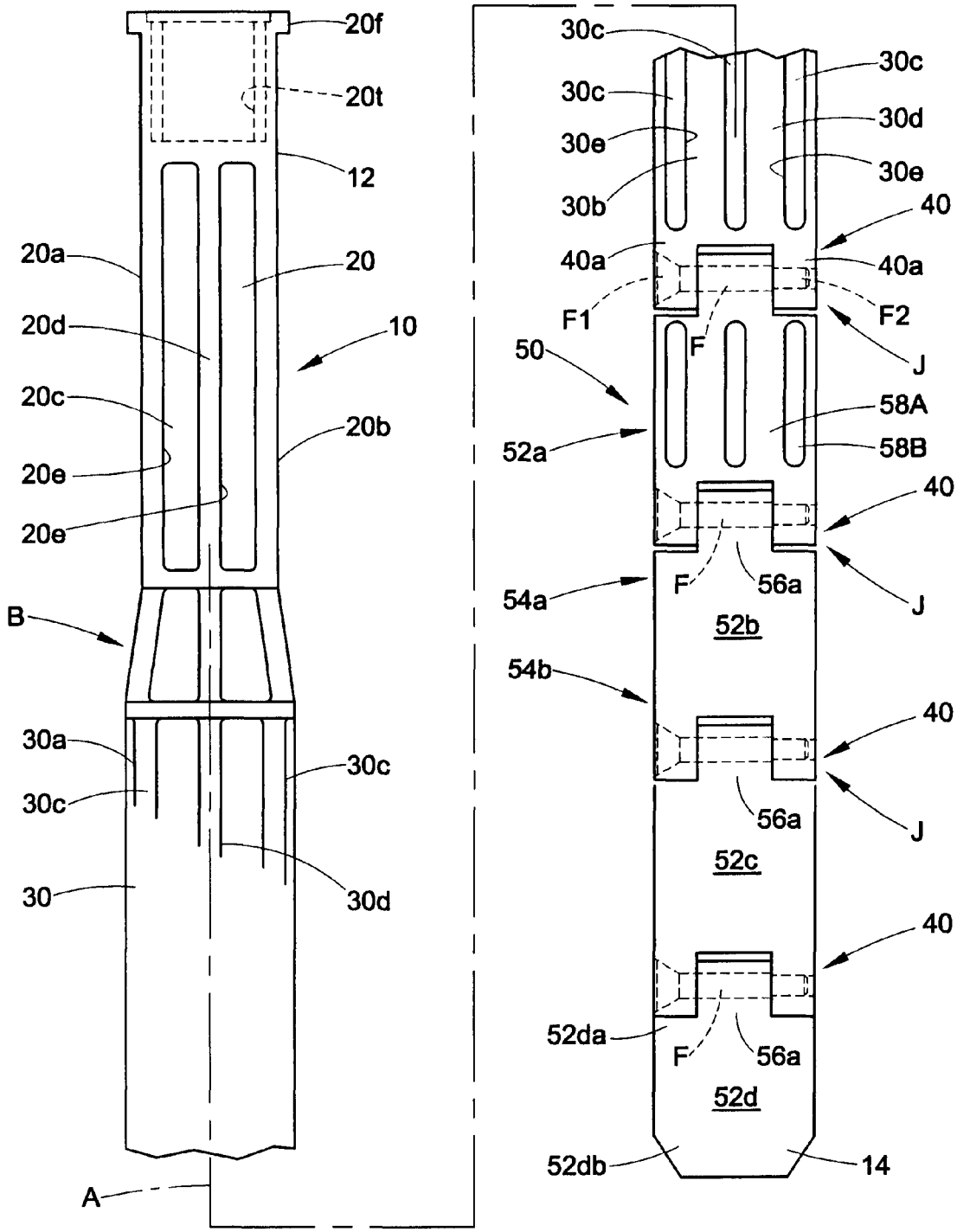
FIG. 2 is a front view of an articulated link duster support frame formed in accordance with the present invention.

FIG. 1 and FIG. 2 are side and front views of an articulated link duster support frame 10 formed in accordance with the present invention. The duster support frame 10 includes a first (handle) end 12 and a second end 14 spaced from the handle end 12 along a longitudinal axis A. The duster 10 can have any desired overall length between its first end 12 and second end 14, e.g., 20-30 inches more or less.

A handle 20 is formed to be suitable for human grasping and use of the duster 10. The handle can be cylindrical or polygonal or contoured or otherwise shaped to be comfortable for human grasp. As shown the handle comprises first and second spaced apart arcuate or otherwise curved surfaces 20*a*,20*b* connected by a first wall or web 20*c*. A second wall or web 20*d* is arranged perpendicular or otherwise transverse to the first web 20*c* and also extends along the axis A, which results in multiple slots 20*e* being defined by the handle 20. The handle 20 preferably includes a threaded blind bore or other opening 20*t* at the first end 12 of the duster 10 for selective and removable attachment of a threaded extension handle or pole by insertion of a threaded stud of the handle/pole therein. An external annular flange 20*f* projects from the handle at the first end 12 of the duster 10 to aid in grasping the handle 20. Such a handle 20 structure is comfortable, sturdy, can be injection molded from a polymeric material, and reduces material cost and weight.

The duster support frame further comprises a shaft or stem 30 that is connected to and projects axially outward from the handle 20. As with the handle 20, the stem 30 can be defined with any suitable desired shape. As shown, the stem 30 is a flattened, blade-like member comprising a first end 30*a* adjacent the handle 20 and a second end 30*b* axially spaced from the first end 30*a*. Parallel spaced-apart walls 30*c* and at least one central web 30*d* cooperate to define slots 30*e* that reduce weight and facilitate injection molding from a polymeric material. The second end 30*b* of the stem 30 comprises a clevis or like structure 40 comprising first and second spaced-apart projections or ears 40*a* so as to be adapted for rotatable connection of a mating link structure as described herein.

Preferably, as shown herein, the handle 20 and stem 30 are defined as a one-piece molded polymeric or "plastic" construction to define a rigid base B, using filled or unfilled polymeric material. Other structure and materials can be used to define the handle 20 and/or stem 30, and they can alternatively be separate pieces that are assembled to define the base B.

The duster support frame 10 further comprises an adjustable working region 50 connected to and projecting outwardly from the stem 30 of base B and defined by a single one or a plurality of two or more rotatable or articulated links 52*a*, 52*b*, 52*c*, 52*d* (or generally 52) that are connected together in series. Except for the final or tip link 52*d* (in the illustrated example), each link 52 is identical and comprises a first end 54*a* comprising a projecting tab 56*a* and a second end 54*b* that comprises the clevis or like structure 40 (as also located on the second end 30*b* of stem 30) including the two spaced-apart projections or ears 40*a*.

Figure 3A:
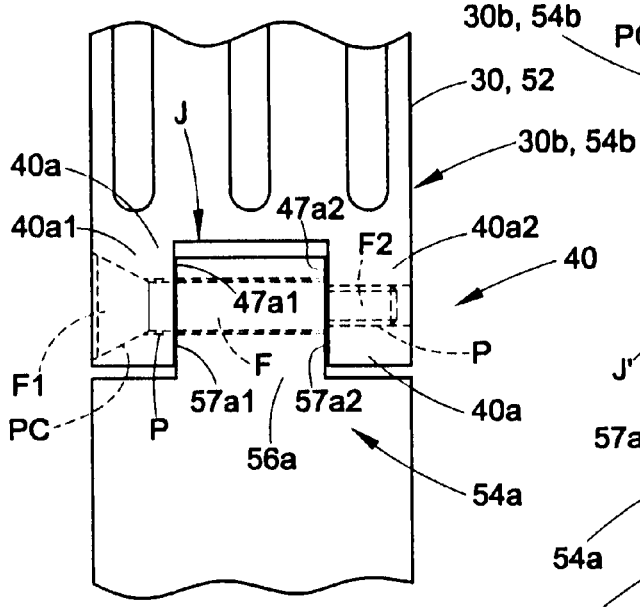
FIG. 3A is a greatly enlarged view showing the link joint structure of the duster support frame of FIGS. 1 and 2.

The innermost or first link 52*a* rotatably connects to the stem 30 by insertion of the tab 56*a* thereof between the stem ears 40*a* with a close sliding fit. Referring also to FIG. 3A, a screw or other fastener F, having a head F1 adapted to be drivingly engaged by a screwdriver or other tool and a tip F2, is inserted through aligned/registered apertures P in the ears 40*a*1,40*a*2 (generally 40*a*) and tab 56*a* to define an articulating joint J. Preferably the tab 56*a* fits between the ears 40*a*1, 40*a*2 with a close, sliding friction fit that allows manual rotation of the link 52*a* relative to the stem 30 but that also prevents unintended rotation of the link 52*a* during movement or intended use (light dusting) of the duster 10 after the fastener F is installed. In particular, the tab 56*a* includes opposite outwardly (relative to axis A) facing parallel transverse faces 57*a*1,57*a*2 and the tabs 40*a*1,40*a*1 include respective inwardly facing transverse faces 47*a*1,47*a*2 that face and are parallel to each other, and the transverse tab faces 57*a*1, 57*a*2 are slidably abutted with the transverse ear faces 47*a*1, 47*a*2, respectively, preferably with minimal clearance (most preferably zero clearance) therebetween to minimize any lateral movement of the tab 56*a* between the ears 40*a*1,40*a*2. The fastener F can be tightened or loosened to increase or decrease, respectively, the friction between the adjacent contacting sides of the tab 56*a* and ears 40*a*. Preferably, only the tip F2 of the fastener F is in threaded engagement with the ear 40*a*2 in which it is received, while the fastener F is not in threaded engagement with the ear 40*a*1 in contact with the fastener head F1 and is not in threaded engagement with the tab 56*a*, so that threaded advancement of the fastener F causes the ears 40*a* to be drawn together to increase the frictional engagement of the ears 40*a* on opposite sides of the tab 56*a*. This can be seen by the reduced diameter of the aperture P in the ear 40*a*2 as compared to the diameter of the aperture P in the ear 40*a*1 and tab 56*a*. In general terms, this can be described as the fastener F being threadably engaged with only the outermost ear 40*a*2, with outermost being defined as relative to the head F1 of the fastener F. In the illustrated embodiment, the fastener F can be a self-tapping screw (preferred if the fastener is metal) and/or the aperture of the ear 40*a* with which the fastener F is threadably engaged can be tapped (preferred if the fastener is polymeric). The fastener head F1 is preferably counter-sunk in and frictionally engaged with the ear 40*a* with which it is in contact so that the fastener head F1 is manually rotatable with a screwdriver or other tool but also so that fastener F resists rotation in response to articulation of the links 52 during use of the duster support frame 10. In an alternative embodiment, the fastener F can simply be slidably inserted through the aligned apertures of the ears 40*a* and tab 56*a*, and a nut can be secured to the tip F2 of the fastener F (in which case the nut can be counter-sunk and restrained against rotation in the outermost ear 40*a* with which the nut is in contact.

Those of ordinary skill in the art will recognize that the second and third and tip links 52*b*,52*c*,52*d* are connected in the same manner as shown in FIG. 3A, by locating the tab 56*a* of one link 52 between the ears 40*a* of a preceding adjacent link and using a fastener F inserted through registered apertures in the tab 56*a* and ears 40*a* as described above for the first link 52*a* to define another articulating joint J as shown in FIG. 3A (note that FIG. 3A is numbered accordingly, showing that the ears 40*a* can be part of the stem 30 or another link 52). The final or tip link 52*d* can be identical to the other links. Alternatively, as shown herein, the tip link 52*d* comprises a first end 52*d* a that is identical to the first end 54*a* of the other links 52, but comprises a second end 52*d* b without ears 40*a* or other structure so as to be plain, e.g., tapered as shown, for aesthetics and to facilitate mounting of a dusting member as described below.

All links 52 are preferably each defined by a one-piece molded polymeric structure that includes various walls 58*a* and ribs 58*b* as desired for strength and to facilitate the molding operation. Typically, the material for the links 52 will match the material for the handle 20 and stem 30 (base B). The fasteners F can be metal or polymeric screws or other suitable fasteners such as rivets or pins.

Figure 3B:
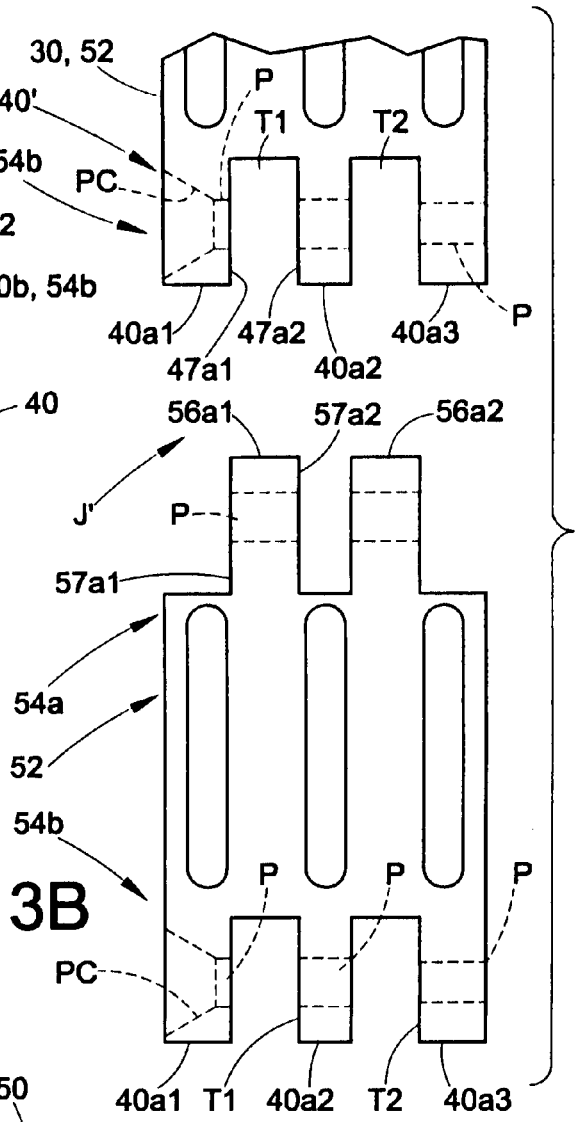
FIG. 3B is similar to FIG. 3A but shows an alternative link joint structure that can be used to construct an articulated link duster support frame in accordance with the present invention.

FIG. 3B shows an alternative joint structure J' for the second end 30*b* of the stem 30 and the second end 54*b* of each link, wherein an alternative clevis structure 40' comprises three ears 40*a*1,40*a*2,40*a*3 so as to define two slots T1,T2 between the inner and middle ears 40*a*1,40*a*2 and between the middle and outer ears 40*a*2,40*a*3, respectively. Correspondingly, the first end 54*a* of each link 52 includes two tabs 56*a*1,56*a*2 that are respectively received in the slots T1,T2. Each slot T1 includes the above described inwardly facing transverse ear surfaces 47*a*1,47*a*2 and each tab 56*a*1,56*a*2 includes the above described outwardly facing transverse surfaces 57*a*1,57*a*2 that slidably abut the respective transverse ear surfaces 47*a*,47*a*2 when the tab is received in the slot. The joint J' also includes a fastener F (not shown in FIG. 3B) that is received through the registered apertures P of the ears 40*a*1,40*a*2,40*a*3 and tabs 56*a*1,56*a*2. It can be seen in FIG. 3B, as described above, that the aperture P in the outermost ear 40*a*3 is smaller in diameter as compared to the remainder of the apertures P so that the fastener F will only be threadably engaged with the portion of the aperture P defined in the outermost ear 40*a*3 so that threaded advancement of the fastener F will increase the frictional engagement between the abutting sides of the ears 40*a*1,40*a*2,40*a*3 and tabs 56*a*1, 56*a*2. Also, as noted above, the aperture P defined in the innermost ear 40*a*1 includes a counter-bore portion PC in which the fastener head F1 is counter-sunk. Preferably, the fastener head F1 is tightly frictionally received in the counter-bore portion PC so that the fastener F1 resist rotation in the apertures P in response to articulation of the joint J', but can still be rotated with by a screwdriver or other mating too engaged with the fastener head F1. The number of ears 40*a*1, 40*a*2,40*a*3 and tabs 56*a*1,56*a*2 of the joint J' can be increased from the illustrated example, but it is preferred that, in all cases, the number of tabs 56*a*1,56*a*2 be only one less than the number of ears 40*a*1,40*a*2,40*a*3 so that all slots T1,T2 receive at least one tab 56*a*1,56*a*2.

Those of ordinary skill in the art will recognize that a duster support frame 10 formed in accordance with the present development includes the base B and at least one link 52 connected thereto by a joint J or J' to define the adjustable working region 50, although typically four or more links 52 will be interconnected to define the working region 50.

Also, those of ordinary skill in the art will recognize that the structure of the joint J or J' can be reversed, with the ears

40*a* (40*a*1,40*a*2, etc.) connected to the first end 54*a* of each link 52 and the tab 56*a* or tabs 56*a*1,56*a*2 connected to the second end 30*b* of the stem 30 and connected to the second end 54*b* of each link 52. In this sense, the ears 40*a* (40*a*1, 40*a*2, etc.) define a first portion or side of each joint J or J' and the tab(s) 56 (56*a*1,56*a*2, etc.) define a second portion or side of each joint J or J'. Also, the support frame 10 can comprise a mixture of joints joint J and J'.

Figure 4:
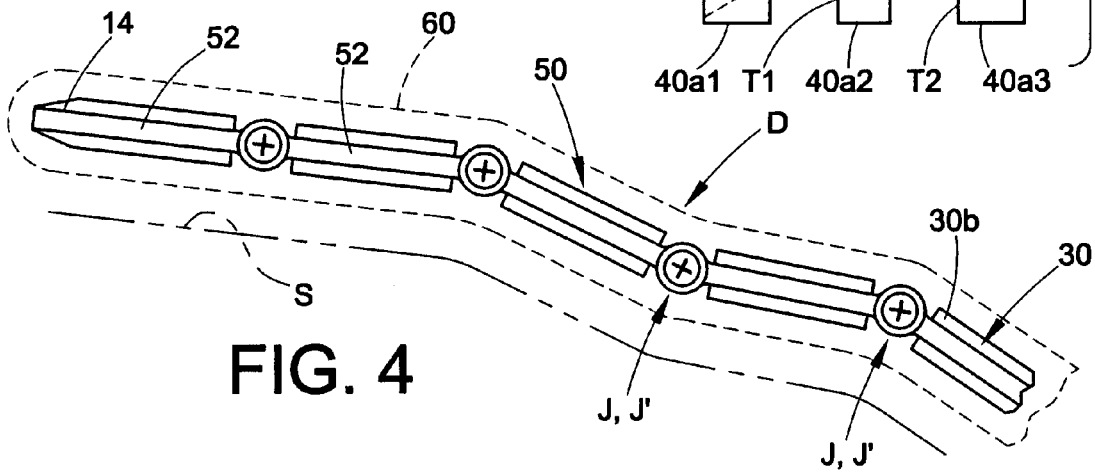
FIG. 4 is a partial side view of a duster formed in accordance with the present development, showing the bendable or articulated working region of the articulated link duster support frame of FIGS. 1 and 2, and showing a dusting cloth installed thereon.

FIG. 4 shows a dusting member 60 such as a cloth or natural or synthetic fabric or feather cover that is installed on the working region 50 of the duster support frame 10 to define an articulated link duster D, e.g., by sliding an open end of a sock-like member 60 over the tip 14 and securing same with a drawstring, a hook-and-loop fastening element such as VELCRO brand fastening element or otherwise. A flat or contoured or other surface S can be dusted easily by manually adjusting the shape of the working region 50 to conform or correspond to the surface S to be dusted by rotating the links 52 to desired positions relative to each other. As noted, the joints J,J' are defined with sufficient frictional interaction to that once the working region 50 is manually adjusted to a desired shape, normal use of the duster for light dusting and movement of the duster will not result in a change of shape for the working region 50. The joints J,J' preferably can rotate at least plus (+) or minus (−) 120 degrees from a central or home position on the axis A. Over time, if the joints loosen, the fasteners F can be tightened to increase the friction in the joints J,J' and, thus, the resistance to articulation during use. The length of the working region 50 can be adjusted by altering the number of installed links 52. The successive joints J,J' can be referred to herein as first, second, third, etc. joints moving outwardly from the base B as need to distinguish them from each other.

The development has been described with reference to preferred embodiments. Modifications and alterations will be apparent to those of ordinary skill in the art after reading this specification, and it is intended that the invention be construed to the fullest possible extent to encompass all such modifications and alterations.

The invention claimed is:

1. An articulated link duster support frame comprising:

a base;

a working region connected to the base and adapted to support a dusting member, said working region comprising at least one link pivotally secured to said base by a joint, said joint comprising at least two ears, at least one tab located between said ears, and a fastener installed in respective aligned apertures of said ears and said at least one tab;

wherein said ears project outwardly from one of said base and said at least one link, and said at least one tab projects outwardly from the other of said base and said at least one link; and, wherein said fastener comprises a threaded fastener comprising a head, said fastener threadably engaged in the aperture of only an outermost one of said ears that is spaced farthest from said head of said fastener such that:

(i) said fastener is rotated in a first direction relative to said ears to increase frictional engagement between said ears and said at least one tab; and, (ii) said fastener is rotated in a second direction relative to said ears to decrease frictional engagement between said ears and said at least one tab;

wherein said aperture of said outermost ear is reduced in diameter as compared to said aperture of each other ear and said aperture of each tab.

2. The articulated link duster support frame as set forth in claim 1, wherein said joint comprises at least two tabs and at least three ears.

3. The articulated link duster support frame as set forth in claim 2, wherein said at least three ears define at least two slots, with each slot defined between first and second ears, and wherein one of said tabs is located in each slot, with opposite outwardly facing transverse faces of each tab slidably abutted with respective inwardly facing first and second transverse surfaces of said first and second ears.

4. The articulated link duster support frame as set forth in claim 2, wherein said joint comprises one less tab as compared to the number of ears.

5. The articulated link duster support frame as set forth in claim 1, wherein said head of said fastener is countersunk into and frictionally engaged with one of said ears.

6. The articulated link duster support frame as set forth in claim 1, wherein said working region comprises a plurality of links connected in series, with an inner link connected to the base by said joint and at least one additional link connected to the inner link by a second joint, wherein said second joint comprises:

at least two second-joint ears and at least one second-joint tab located between and slidably abutted with said at least two second-joint ears, and a second fastener installed in respective aligned apertures of said at least two second-joint ears and said at least one second-joint tab;

wherein said at least two second-joint ears project outwardly from one of said inner link and said additional link, and said at least one second-joint tab projects outwardly from the other of said inner link and said additional link; and, wherein said second fastener comprises a second threaded fastener threadably engaged in the aperture of only one of said second-joint ears such that:

(i) said second fastener is rotated in a first direction relative to said second-joint ears to increase friction in said second joint; and, (ii) said second fastener is rotated in a second direction relative to said second-joint ears to decrease friction in said second joint.

7. The articulated link duster support frame as set forth in claim 1, wherein said base comprises a handle and a stem that projects from said handle, and wherein said at least one link is connected to said stem by said joint.

8. The articulated link duster support frame as set forth in claim 1, wherein said base and said at least one link are each defined as respective one-piece polymeric constructions.

9. An articulated link duster comprising:

a base;

a working region connected to the base, said working region comprising a plurality of links pivotally connected in series such that each link is pivotally connected to at least one adjacent link, with an inner one of said links pivotally connected to the base, a dusting member installed on the working region;

wherein respective articulated joints pivotally connect said inner link to said base and pivotally connect each link to at least one adjacent link, wherein each joint comprises:

a first side comprising at least two ears and a second side comprising at least one tab located between said ears, and a fastener pivotally connecting the first and second sides;

said fastener comprising a threaded fastener including a head, said fastener located in aligned apertures of each of said ears and said at least one tab, with said fastener threadably engaged in the aperture of only an outermost one of said ears that is spaced farthest from said head of said fastener;

wherein said aperture of said outermost ear is reduced in diameter as compared to said aperture of each other ear and said aperture of each tab.

10. The articulated link duster as set forth in claim 9, wherein each joint comprises at least two tabs and at least three ears.

11. The articulated link duster as set forth in claim 10, wherein, for each joint, said at least three ears define at least two slots, with each slot defined between first and second ears, and wherein one of said tabs is located in each slot, with opposite outwardly facing transverse faces of each tab slidably abutted with respective inwardly facing first and second transverse surfaces of said first and second ears.

12. The articulated link duster as set forth in claim 11, wherein each of said joints comprises one less tab as compared to the number of ears.

13. The articulated link duster as set forth in claim 9, wherein said head of said fastener is countersunk into and frictionally engaged with one of said ears.

* * * * *